United States Patent [19]

Yano et al.

[11] Patent Number: 4,666,786

[45] Date of Patent: May 19, 1987

[54] SLIDING SURFACE OF COMPOSITE NICKEL-PLATED SLIDING MEMBER

[75] Inventors: Hideo Yano; Keiichi Kano, both of Aichi; Hitoshi Ozawa, Shizuoka; Shinji Kato; Yoshio Takagi, both of Aichi, all of Japan

[73] Assignees: Aisin Seiki Kabushiki Kaisha, Kariya; Toyota Jidosha Kabushiki Kaisha, Toyota, both of Japan

[21] Appl. No.: 706,334

[22] Filed: Feb. 27, 1985

[30] Foreign Application Priority Data

Mar. 19, 1984 [JP] Japan ..... 59-52687

[51] Int. Cl.[4] ..... C23C 18/36

[52] U.S. Cl. ..... 428/544; 427/438; 427/443.1; 428/612; 428/627; 428/652; 428/680

[58] Field of Search ..... 427/443.1, 438; 428/544, 612, 627, 652, 680

[56] References Cited

U.S. PATENT DOCUMENTS 3,617,363 11/1971 Metzger .

FOREIGN PATENT DOCUMENTS 390776 11/1967 Fed. Rep. of Germany .

OTHER PUBLICATIONS

Hubbell, "Chemically Deposited Composites-A New Generation of Electroless Coatings" Plating & Surface Finishing, Dec. 1978, pp. 58-62.

Feldstein et al, "The State of the Art in Electroless Composite Plating" The First AES Electroless Plating Symposium, Mar. 23-24, 1982 St. Louis, MO, pp. 1-17.

*Primary Examiner*—John D. Smith

*Attorney, Agent, or Firm*—Oblon, Fisher, Spivak, McClelland & Maier

[57] ABSTRACT

A composite nickel plated sliding surface is obtained by the formation of a composite nickel plating film on a sliding surface of an automobile part such as an engine cylinder or piston by electroless nickel plating. The plating film contains at least one member of wear resistant particles having an average particle size of 0.1 to 1.0μ selected from SiC, TiC, WC, $BC_4$, TiN, $Al_2O_3$ or the like, and also at least one member of lubricating particles having an average particle size of 1 to 10μ selected from BN, $MoS_2$, and Teflon. The nickel plating bath is adjusted to have a phosphorus concentration of 0.5 to 12%. When the matrix of the nickel plating film has a phosphorus concentration of 0.5 to 5%, the film hardness is improved.

3 Claims, 2 Drawing Figures

SLIDING SURFACE OF COMPOSITE NICKEL-PLATED SLIDING MEMBER

BACKGROUND OF THE INVENTION

1. Field of the Invention:

This invention relates generally to an improvement in wear and seizing resistance of a sliding surface of a sliding member such as a piston used in an engine, on which a composite plating film is formed.

2. Description of the Prior Art:

Plated sliding surfaces of sliding members on which composite plating films are formed are known, such as:

(1) Gazette No. 55-154600 for Published Unexamined Patent Application (Published in Japan in 1980), and (2) Gazette No. 57-71812 for Published Unexamined Patent Application (Published in Japan in 1982).

Publication (1) describes a nickel-plated sliding surface. In this technique, a composite nickel plating containing a solid lubricant is formed on a base surface with a micro three-dimensional structure so as to provide a composite nickel plating film with a three-dimensional structure on the base surface. Publication (2) describes a composite nickel plating method which uses extremely pure silicon carbide fine powder having an excellent dispersibility. In addition to these techniques, a hardening method using a nickel-phosphorus plating film is known. In this method, a nickel plating film having a phosphorus concentration of 5 to 12% is formed on a product. Then, it is heated to a temperature within a range of 270 to 400° C. in a heating furnace and is kept at this temperature for 0.5 to 4 hours.

However, there are some drawbacks with these prior art techniques. In the process of publication (1) for forming the nickel-plated sliding surface on which a composite nickel plating film is formed, boron nitride as a solid lubricant is dispersed as a composite material in the nickel plating film so as to improve lubricating characteristics of the sliding surface. However, this sliding surface has poor wear and seizing resistance. In the process of publication (2) for forming the composite nickel plating film using a silicon carbide fine powder, silicon carbide fine particles having an average particle size of 1μ or less and dispersed in a nickel bath serve to improve wear resistance. However, the lubricating characteristics of the sliding surface are poor. In addition, silicon carbide particles separated from the sliding surface act as a abrasive which causes wear in a mating member.

In the method of hardening a nickel plating film having a phosphorus concentration of 5 to 12%, if the sliding member consists of Al or an Al alloy, a heat treatment for hardening the film results in degradation in the strength of the film material and a change in size of the member.

SUMMARY OF THE INVENTION

It is a technical object of the present invention to obtain, in the formation of a composite nickel plating film on a base surface, a composite nickel plating film which imparts excellent wear and lubricating characteristics to a sliding surface and which is hardened without being subjected to a heat treatment.

According to a technical means to achieve the above technical object of the present invention, there is provided a sliding surface which is obtained by the formation of a nickel alloy plating film on a base surface in an electroless nickel sulfate or chloride plating bath which has a phosphorus concentration of 0.5 to 5% in which are suspended fine particles of a cubic material having high hardness and wear resistance and an average particle size of 0.1 to 1.0μ, such as silicon carbide (SiC), titanium carbide (TiC), tungsten carbide (W.C), boron carbide ($BC_4$), titanium nitride (TiN), or aluminum oxide ($Al_2O_3$), and fine particles of a soft material having self-lubricating characteristics and an average particle size of 1 to 10μ such as boron nitride (BN), molybdenum disulfide ($MoS_2$), or Teflon.

A sliding surface having a nickel alloy plating film in which cubic silicon carbide and boron nitride, for example, are dispersed has the following advantages:

(1) The sliding surface has the wear resistance of silicon carbide and the lubricating characteristics of boron nitride. The sliding surface of the base element does not cause seizing even under a high load.

(2) When cubic silicon carbide is used, each fine cubic particle having an average size of 0.1 to several microns has fewer corners than that of hexagonal silicon carbide. Furthermore, since the particles are almost spherical in shape, only slight wear occurs. Thus, the amount of wear of a mating member is about ½ that which occurs with a sliding surface using hexagonal silicon carbide.

(3) When a heat treatment is not performed and the plating film has a phosphorus concentration of 5 to 12%, the film has a hardness of about 600 mHV. However, when the phosphorus concentration is reduced to 0.5 to 5%, the hardness is increased up to about 700 mHV.

The technique of the present invention has the following particular advantages:

(1) When fine particles of silicon carbon having an average particle size of 0.1 to 1.0μ are used, wear of a mating member is significantly reduced. When the average particle size exceeds 1.0μ, wear of a mating member increases. Also, when the average particle size is 0.1μ or less, wear resistance of the sliding surface is not improved. When the size of the boron nitride particles is increased to 10μ or more, the film is fragile and wear resistance is impaired.

(2) When an Al alloy piston slides against an Al alloy cylinder, if the piston has a composite nickel plating film according to the present invention, scuffing (dragging of the cylinder and scratching of the piston) is reduced by 50%.

(3) Since a heat treatment for hardening the film is not performed, post-treatment such as grinding or polishing to adjust the size after hardening the film is not necessary.

BRIEF DESCRIPTION OF THE DRAWINGS

A better understanding of the prior art and of the present invention will be obtained by reference to the detailed description below, and to the attached drawings, in which.

DETAILED DESCRIPTION OF THE PREFERRED EMBODIMENTS

Figure 1:
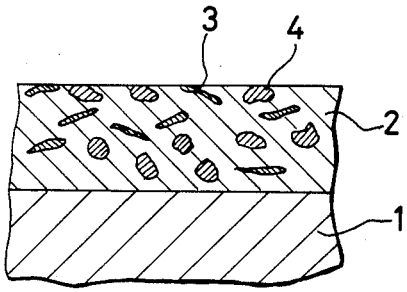
FIG. 1 is an enlarged sectional view of a composite plated sliding surface according to an embodiment of the present invention.

The present invention will now be described by way of its examples below which exemplify the technical means described above.

EXAMPLE 1

Al test pieces (6.35×10.1×15.6 mm, 5×30×30 mm) were subjected to composite nickel plating in a nickel bath in which BN (lubricating particles) and SiC (wear resistant particles) were dispersed and nickel-plated sliding surfaces were formed on the test pieces.

Bath Composition

| | |
|---|---|
| Nickel sulfate | 25 g/l |
| Hydrophosphate | 25 g/l |
| Sodium propionate | 3 g/l |
| Wetting agent | 1 ml/l |
| SiC (0.45μ average particle size) | 2 g/l |
| BN | 2 g/l |

Plating Condition

Bath temperature 86±1° C., pH 5.0±0.2

The sliding surfaces treated under the above conditions were evaluated for their seizing resistance, wear resistance and lubricating characteristics by Suzuki and LFW-No. 1 testers. Table 1 below shows a comparison of the results obtained from the above conditions with those obtained with a composite nickel plating bath containing BN only as a dispersed material and with a composite nickel plating bath containing SiC only as a dispersed material.

TABLE 1

| | | Seizing Load | Friction Coefficient | Film Friction Width |
|---|---|---|---|---|
| 1 | SiC + BN | 1.0 | 0.024 | 1.0 |
| 2 | BN only | 0.86 | 0.019 | 3.0 |
| 3 | SiC only | 1.29 | 0.057 | 0.69 |

(Note)
Seizing load and film friction width are relative values.

The wear resistance of the plating film could be improved without impairing the lubricating characteristics by coprecipitating SiC particles.

EXAMPLE 2

Composite nickel plating was performed using both BN and SiC as dispersed materials under the same conditions as in Example 1. Table 2 shows the results obtained in a case wherein the SiC had a cubic crystal structure and a case wherein the SiC had a hexagonal structure.

TABLE 2

| | | Seizing Load | Film Friction Width | Wear Depth of Mating Member |
|---|---|---|---|---|
| 1 | Hexagonal | 1.0 | 1.0 | 1.0 |
| 2 | Cubic | 0.79 | 0.85 | 0.53 |

(Note)
Values are relative values.

When cubic SiC having an average particle size of 0.45μ was used, the wear resistance of the nickel plating film was improved and the amount of wear of a mating member was reduced (conventionally, these advantages cannot be achieved at the same time) as compared to hexagonal SiC having the same average particle size.

EXAMPLE 3

A 4-cycle engine piston (Al alloy material) was treated under the following conditions. The piston was actually mounted on an engine using a high-silicon material (17% Si) liner and its performance was tested.

Bath Composition

| | |
|---|---|
| Nickel Chloride | 12 g/l |
| Hydrophosphate | 4 g/l |
| Glycine | 15 g/l |
| SiC (cubic, 0.45μ average particle size) | 2 g/l |
| BN | 2 g/l |

Plating Condition

Bath temperature 90±1° C., pH 6.0±1

When plating was performed under the following conditions, an electroless composite nickel plating film was obtained which had a phosphorus concentration of 1.2 to 1.5% and a hardness of 700 mHV.

When the piston subjected to the surface treatment according to the present invention was operated for 100 hours, no seizing or scuffing occurred.

However, when a conventional composite plating was performed with a bath having a phosphorus concentration of 7%, seizing and scuffing occurred. FIG. 1 is an enlarged view of a sliding surface obtained by the above method. Referring to FIG. 1, reference numeral 1 denotes an Al alloy element; 2, a nickel-phosphorus plating film; 3, BN fine particles; and 4, SiC fine particles.

Figure 2:
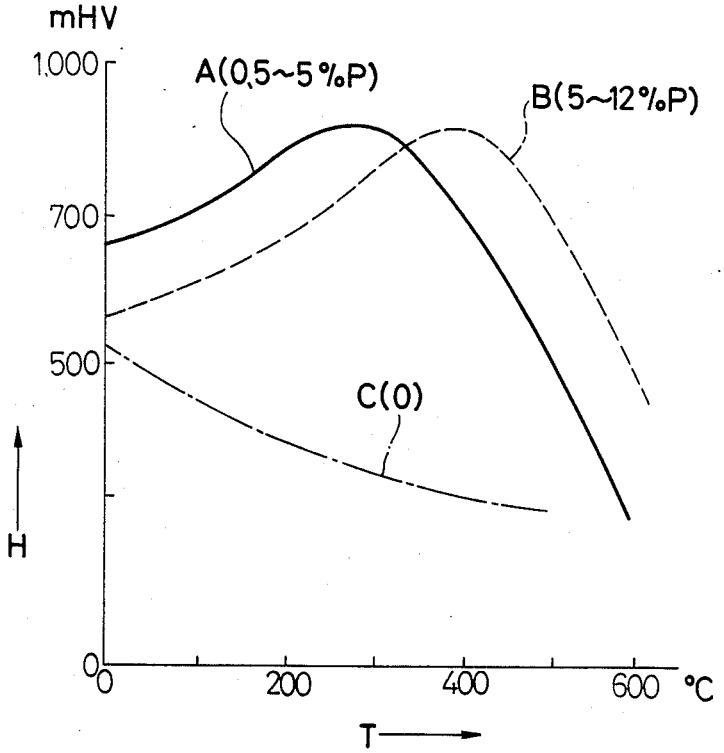
FIG. 2 is a graph showing the relationship between the hardness of a nickel-phosphorus alloy plating film and the heat treatment temperature.

FIG. 2 is a graph showing variations in the hardness of the nickel-phosphorus plating film according to changes in the temperature. Hardness H is plotted along the axis of ordinate, and heat treatment temperature T is plotted along the axis of abscissa. Curves A, B, and C correspond to phosphorus concentrations of 0.5 to 5%, 5 to 12%, and 0%, respectively.

In a nickel bath where wear resistant particles such as boron carbide, titanium nitride and aluminum oxide having a size of 0.1 to 1.0μ and fine particles having good lubricating characteristics such as molybdenum disulfide and Teflon having a size of 1 to 10μ were dispersed, the wear resistance of the plating film was improved and the amount of wear of a mating member was reduced (conventionally, both these advantages cannot be achieved at the same time) to the degrees shown in the above Examples.

What is claimed as new and desired to be secured by Letters Patent of the United States is:

1. A composite plated sliding surface of a sliding member, on which a nickel alloy film containing water resistant particles and lubricating particles are dispersed is formed by using a nickel plating bath having a phosphorus concentration of 0.5 to 12%, comprising silicon carbide having a cubic crystalline structure particles as the wear resistant particles having an average particle size of 0.1 to 1.0μ and boron nitride particles as the lubricating particles having an average particle size of 1 to 10μ.

2. A sliding surface according to claim 1, wherein a matrix of the nickel alloy film has a phosphorus concentration of 0.5 to 5%.

3. A method of performing composite nickel plating on a sliding surface of a sliding member, comprising the steps of dispersing wear resistant particles and lubricating particles in a nickel plating bath adjusted to have a phosphorus concentration of 0.5 to 12%, in which the wear resistant particles having an average particle size of 0.1 to 1.0μ and being silicon carbide having cubic crystalline structure, and the lubricating particles having an average particle size of 1 to 10μ and being boron nitride; and forming a nickel alloy film containing the wear resistant particles and the lubricating particles on the sliding surface of said sliding member by electroless plating.

* * * * *